United States Patent [19]

Francis, Jr. et al.

[11] Patent Number: 5,047,744

[45] Date of Patent: Sep. 10, 1991

[54] HIGH VOLTAGE FLUID FILLED TRANSFORMER

[75] Inventors: Ralph M. Francis, Jr.; John C. Mastopietro, both of Racine, Wis.

[73] Assignee: Plasma Technics, Inc., Racine, Wis.

[21] Appl. No.: 468,545

[22] Filed: Jan. 23, 1990

[51] Int. Cl.[5] ..... H01F 27/10

[52] U.S. Cl. ..... 336/58; 174/12 R; 174/17 LF; 174/18; 174/17.07; 336/94

[58] Field of Search ..... 174/12 R, 17 R, 17 LF, 174/18, 17.07; 336/55, 58, 94

[56] References Cited

U.S. PATENT DOCUMENTS

| | | | |
|---|---|---|---|
| 3,474,369 | 10/1969 | Keogh | 174/18 X |
| 3,512,118 | 5/1970 | Leonard | 174/18 X |
| 3,766,505 | 10/1973 | Sato et al. | 336/94 |
| 3,905,001 | 9/1975 | Sato et al. | 336/94 |
| 3,986,080 | 10/1976 | Sato | 336/94 X |

*Primary Examiner*—Thomas J. Kozma

*Attorney, Agent, or Firm*—Quarles & Brady

[57] ABSTRACT

A transformer of the type used to produce high voltage for an electrostatic field apparatus has a hermetically sealed container. The container encloses a coil assembly having primary and secondary coils wound on a common core. Electrical terminals extend outward from the container and are connected to the coils. The interior volume of the container is completely filled with a thermally conductive, electrically non-conducting fluid. The internal pressure of the transformer is less than one atmosphere at 22° C. The transformer can be operated in any mounting orientation of its rated power. A method of manufacturing the transformer is described by which gases are removed from the container so that it can be completely filled with the fluid.

6 Claims, 1 Drawing Sheet

HIGH VOLTAGE FLUID FILLED TRANSFORMER

BACKGROUND OF THE INVENTION

The present invention relates to electrical transformers, and more specifically to high voltage transformers used in equipment for generating electrostatic fields and discharges.

Various types of electrostatic apparatus, such as neon signs, electrostatic filters and copiers, and corona discharge devices, utilize transformers to convert 120 or 240 volts from an alternating electric current source to output levels up to 15 kilovolts at 500 volt-amperes. The high voltage is used to create an electrostatic field within the apparatus. Typically, the transformers for such apparatus comprise a primary coil and a high voltage secondary coil wound on a metal core which provides inductive coupling between the two coils. The coil assembly is placed in a metal container and surrounded by a potting compound. Traditionally, either asphalt or epoxy based compounds are used to pot the coil assembly. The potting compound serves several purposes holding the coil assembly within the container, transferring heat from the coils to the metal container where it dissipates into the environment, electrically insulating the coils from the core and the container, and protecting against moisture penetration. During the potting process, air is often trapped around the coils creating voids between the potting compound and the coil. Failure of these high voltage transformers can result from a corona discharge occurring in the void and consuming the transformer material, including the coil wires. The intensity of the corona in a void is inversely proportional to the size of the void, making even small trapped air bubbles significant to transformer performance. A void can also promote a chemical reaction which also dissolves the insulation in the immediate area.

Despite the voids, some types of high voltage loads place minimal performance demands on these transformers, permitting satisfactory operation with less than optimal designs. For example, a 10 kilovolt transformer used for neon signs is required to produce the full output voltage only briefly during its normal use. Generally, the full voltage will be required only to initiate the gas discharge. Once ignition has been established, the transformer output voltage will drop to one to three kilovolts as a result of the load's tendency to draw down the output voltage.

However, the same transformer will fail within a few hours when it is used in a corona discharge device. This failure occurs for several reasons. The nature of corona discharge loads generally requires 100 percent duty cycle indefinitely. In addition, the operating temperature of the transformer can be elevated for prolonged periods. Due to the relatively capacitive load that a corona discharge device places on the transformer, the output voltage actually rises by about 20 percent. The conventional potted transformers provide less than optimal performance with loads requiring continuous operation at full output voltage.

SUMMARY OF THE INVENTION

A transformer for producing a high voltage has primary and secondary coils wound on a common magnetically conductive core. This coil assembly sealed within a container having electrical terminals extending therefrom. The coils are connected to the terminals. The interior volume of the container is evacuated and then filled with a thermally conductive and electrically nonconductive fluid. Thus, the volume is entirely filled with fluid and is substantially free of all gas. The fluid in the container is at less than one atmosphere pressure when its temperature is 22° C.

A general object of the present invention is to provide a transformer which can be operated at 100 percent duty cycle and 100 percent rated output.

Another object is to provide a transformer in which all gas has been removed from within the interior of the transformer and replaced by the thermally conductive fluid. This optimizes the transfer of heat from the coils to the container surface and eliminates gas trapped around the coils from causing thermal hot spots in the coils.

A further object of the present invention is to provide a transformer that may be mounted in any orientation and still have its coils and core fully immersed in the fluid.

Still another object of the present invention is to provide environmental humidity immunity by hermetically sealing the transformer.

DETAILED DESCRIPTION OF THE INVENTION

Figure 1:
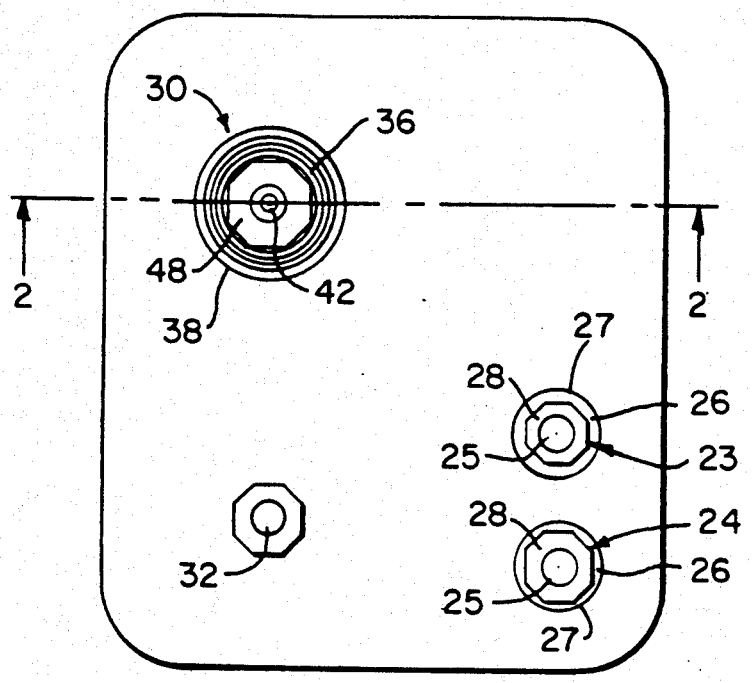
FIG. 1 is a plane view of a top of the transformer according to the present invention.
Figure 2:
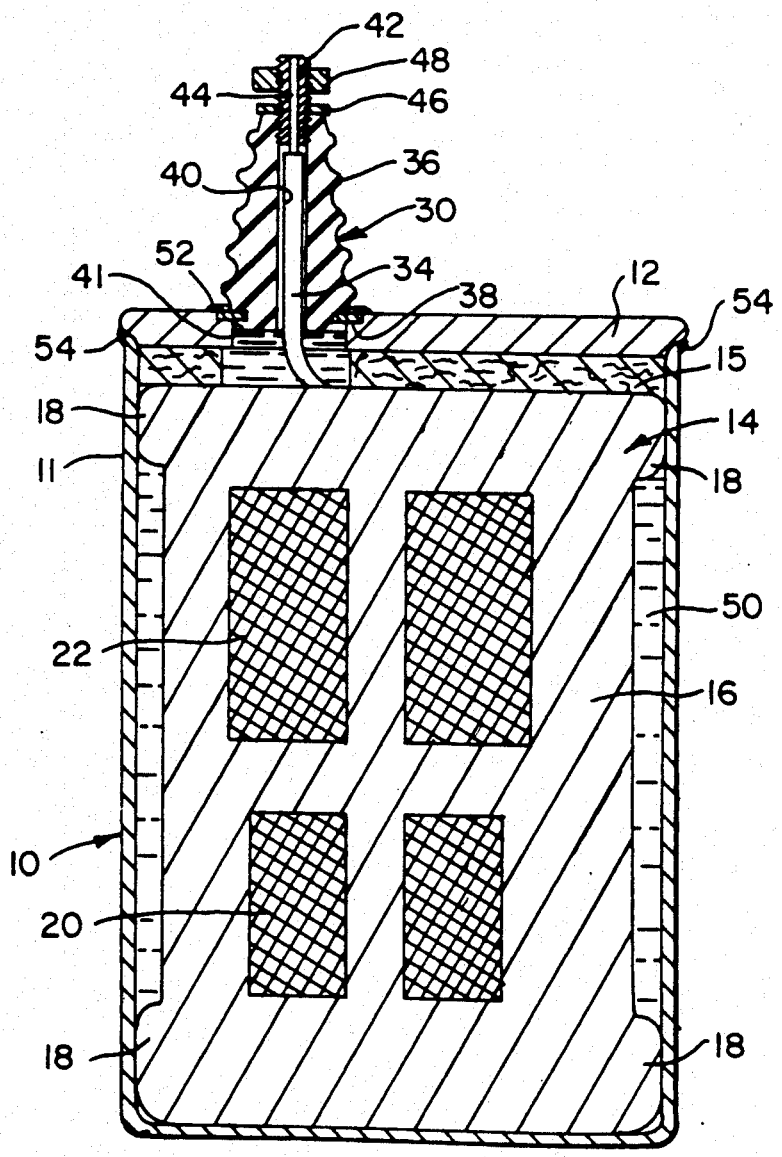
FIG. 2 is a cross-sectional view of the transformer taken along line 2—2 of FIG. 1.

With reference to FIGS. 1 and 2, a high voltage transformer 10 for an electrostatic apparatus includes a housing formed by a drawn metallic can 11 and a cover 12 and are sealed together by soldering, for example. Both the can and the cover are formed of conductive material such as steel, brass or aluminum. Alternatively, a hermetically sealed plastic housing may be used. A coil assembly 14 is positioned within the can 11 and includes a magnetically conductive transformer core 16 which may be a conventional laminated design. The core 16 has four tabs 18 extending from opposite sides and which are in contact with the inner surface of the can 11, thereby holding the coil assembly 14 within the can preventing lateral movement. A sheet of material 15, such as cardboard, is positioned between the transformer core 16 and the cover 12 to prevent vertical movement of the transformer coil in the orientation illustrated in FIG. 2.

The coil assembly 14 further includes a primary coil 20 and a secondary coil 22 both wound around elements of the core 16 so as to be inductively coupled. Each coil 20 and 22 is wound to provide the requisite turns ratio to convert electrical supply line voltage applied to the primary coil to the desired high voltage across the secondary coil. The two leads for the primary coil 20 are coupled to primary coil terminals 23 and 24 to which the electrical supply lines for the transformer are to be connected. Each of the primary coil terminals 23 and 24 is formed by a threaded post 25 embedded in a ceramic insulator disk 26. The ceramic insulator 26 has a metallic outer circumferential surface 27 which is spaced from the threaded post 25 so as to not be in electrical contact. The metallic outer surface 27 of the ceramic insulator 26 allows the primary coil terminal 24 to be soldered to the metallic cover 12 forming a hermetically sealed terminal. A hex nut 28 is threaded onto the post 25 to provide a means for attaching the electrical supply wires to the terminal 24.

The high voltage, secondary coil 22 is electrically connected to a high voltage terminal 30 and a ground terminal 32. The ground terminal 32 is soldered or otherwise permanently fixed directly to the cover 12 and one of the leads from the secondary coil may be either attached to the terminal or connected to either the conductive can 11 or cover 12.

The high voltage terminal 30 includes a tapered ceramic insulator 36 with a solderable metal ring 38 embedded near one end of the post so as to extend radially therefrom. The metal ring 38 bonded to the insulator 36 provides an air-tight seal between those two components. The one end of the high voltage terminal 30 is located within a depression in cover 12 and the outer edge of metal ring 38 is soldered to the cover. Alternatively, the circumferential surface at the one end of the insulator has a solderable coating bonded to it. In this case, the coated end is soldered directly to the cover.

An aperture 40 extends through the insulator 36 along its longitudinal axis and is aligned with an aperture 41 in cover 12. A threaded terminal post 42 is within the aperture 40 and extends from the other end of the insulator 36 which is remote from the cover 12. The terminal post 42 is embedded within the ceramic insulator 36 to provide a hermetic seal therebetween. A conductive washer 46 is positioned on the exposed portion of terminal post 42 and hex nut 48 is threaded onto that terminal post to provide a means for connecting an external conductor to the high voltage terminal 30. An aperture 44 extends through the terminal post 42 along its longitudinal axis. The other lead 34 from the secondary coil 22 extends through aperture 40 in insulator 36 and has its insulation stripped away so that its conductor extends through the aperture 44 in the terminal post 42. The conductor of the secondary coil lead 34 is soldered within the aperture 44.

The transformer 10 is filled with an electrically insulating, thermally conductive fluid 50 of a type which is conventionally used in transformers. However, unlike past transformer designs, the fluid 50 entirely fills the open interior of the transformer 10 so that gas bubbles are not present which may affect the dielectric performance and the thermal coupling between the coil assembly 14 and the can 11. Furthermore, at 22° C., the interior of the transformer 10 is at a negative pressure with respect to normal atmospheric pressure (i.e. the internal pressure is less than one atmosphere). Since air does not remain within the transformer 10, the coil assembly 14 will be completely immersed in the fluid 50 regardless of the orientation at which the transformer is mounted for use. This insures good heat transfer from the coil assembly 14 to the can 11 and cover 12.

A unique process for manufacturing the transformer has been devised to insure that it is filled entirely with fluid 50 without trapped gas. Prior to assembling the transformer, the coil assembly 14 is fabricated, and the four external terminals 23, 24, 30 and 32 are mounted on the cover 12. As noted above, the ground terminal 32 is mounted directly onto the can cover to provide a grounding terminal for the transformer housing. The primary coil terminals 24 are soldered into openings in the cover. Similarly, the high voltage terminal 30 has the outer circumference of its metal ring 38 soldered to the cover 12, as indicated by solder bead 52 in FIG. 2. The mounting of the external terminals 23, 24, 30, and 32 to the cover provide hermetic seals between each of the terminals and the cover.

Once the cover 12 and coil assembly 14 have been fabricated, the final assembly of the transformer 10 may commence. The two leads for primary coil 20 are soldered to their respective terminals 23 and 24 and one lead for the high voltage coil 22 is connected to the ground terminal 32. The coil assembly 14 then is placed within can 11 and the cardboard sheet 14 is placed on top of the assembly. The remaining lead 34 from the secondary coil 22 is inserted within the high voltage terminal 30 so that its insulated portion extends within aperture 40 of the insulator 36 at an exposed portion of its conductor extends into the aperture 44 of terminal post 42. The cover 12 is then placed onto can 11 and a solder bead 54 run around the entire circumferential interface between the can and the cover. At this point, the transformer is sealed, except for the opening which exists between the secondary coil lead 34 and the surfaces of apertures 40 and 44 through the high voltage terminal 30.

The partially assembled transformer 10 is then placed within a vacuum chamber which then is evacuated to a pressure of less than 100 torr. Because a passage exists between the secondary coil lead 34 and the high voltage terminal 30, the interior of the transformer 10 will also be evacuated. This process removes substantially all air within the transformer and eliminates gas being trapped among the coil windings 20 and 22.

Also within the vacuum chamber is a container of transformer fluid which has been heated to a temperature slightly above that which will be encountered during normal operation of the completed transformer. Typically, the fluid is heated to at least 30° C. For example, a transformer used in electrostatic discharge apparatus may have a typical operating temperature of about 100° C. when producing its rated power output. For this type of transformer, the fluid within the vacuum chamber would be heated to approximately 120° C. This heating expands the fluid from its volume at room temperature (e.g. 22° C.).

After the vacuum chamber and the transformer 10 have been evacuated, a material handling system completely submerges the transformer into the heated fluid. The low pressure within the transformer 10 draws the fluid into the can 11 through the high voltage terminal 30. The fluid not only fills the can 11, but also fills the apertures 40 and 44 in high voltage terminal 30 and terminal post 42, respectively. As a result of this process, the entire transformer interior is filled with fluid and is void of any air which otherwise might be trapped among the crevices of the coil assembly 14.

Once a sufficient time has elapsed to insure the entire filling of the interior of the transformer 10, a heating element is placed against the terminal post 44 while the transformer 10 is still totally submerged in the fluid. Solder is applied against the end of the terminal post 42. The solder melts and flows into the aperture 42 to seal the aperture and electrically connect the secondary coil lead 34 to the terminal post 42. This last step.completely seals the transformer 10 so that air cannot subsequently enter its interior.

A vacuum within the chamber is then released and the assembled transformer 10 removed. When the transformer cools to room temperature, the fluid 50 therewithin will contract producing a negative pressure within the transformer with respect to normal atmospheric pressure acting on its exterior surfaces. Furthermore, the can 11 may contract slightly under this negative pressure.

During operation of the transformer 10, when its coil assembly 14 reaches maximum operating temperature, the temperature increase causes an expansion of the fluid 50 and raises the internal pressure. This expansion provides additional thermal capacity within the transformer. Because the transformer was filled with heated fluid under low pressure, the transformer is able to withstand the elevated internal pressure without a release mechanism. In addition, the total outgasing and filling the transformer entirely with fluid insures optimum transfer of heat between the coil assembly 14 and the can 11. Thus, there are no gas pockets to create heat transfer or dielectric voids. As a result, the finished transformer can operate at 100 percent duty cycle at full rated voltage output without experiencing the failure rate as in conventional potted transformers.

What is claimed is:

1. A transformer for producing a high voltage in an electrostatic apparatus comprising:

a hermetically sealed housing having an internal cavity;

a coil assembly within the internal cavity said housing and having a primary coil and a secondary coil wound about a magnetically conductive core;

a first electrical terminal including an elongated electrical insulator hermetically sealed across a hole in said housing and having with a first aperture extending longitudinally therethrough, a means for making electrical connection extending outward from one end of the electrical insulator and hermetically sealed thereto with a second aperture extending therethrough and communicating with the first aperture in the electrical insulator, and means for sealing the second aperture, said secondary coil being connected to the means for making electrical connection;

a plurality of other electrical terminals which extend from said housing and to which the primary and secondary coils are connected; and thermally conductive fluid entirely filling the cavity which is not filled by said coil assembly so that there is substantially no gas within the cavity.

2. The transformed as recited in claim 1 wherein said secondary coil has a lead which extends through the first aperture in said electrical insulator and connects into the second aperture in said means for making electrical connection.

3. The transformed as recited in claim 1 wherein said housing comprises an enclosure having an open end; and a cover extending across the open end and sealed to said enclosure.

4. The transformer as recited in claim 1 wherein the housing has an internal pressure that is below one atmosphere pressure when the fluid has a temperature of 22° C.

5. A transformer comprising:

a hermetically sealed housing having an internal cavity;

a high voltage electrical terminal including an elongated electrical insulator hermetically sealed across a hole in said housing and having with a first aperture extending longitudinally therethrough, a means for making electrical connection extending outward from one end of the electrical insulator and hermetically sealed thereto with a second aperture extending therethrough and communicating with the first aperture in the electrical insulator;

a coil assembly within the internal cavity said housing and having a primary coil and a secondary coil wound about a magnetically conductive core, the secondary coil having a lead extending through the first aperture in the electrical insulator and connected to the means for making electrical connection in a manner which closes the second aperture;

a plurality of other electrical terminals which extend from said housing and to which the primary and secondary coils are connected; and thermally conductive dielectric fluid within the cavity, such that the housing has an internal pressure that is below one atmosphere pressure when the fluid has a temperature of 22° C.

6. The transformer as recited in claim 1 wherein the means for making electrical connection comprises a post having one end section embedded in the electrical insulator and another end section extending from the electrical insulator and having external threads.

* * * * *